US005189758A

United States Patent [19]

Levy

[11] Patent Number: 5,189,758

[45] Date of Patent: Mar. 2, 1993

[54] SUPPORT SYSTEM FOR ~~A FLEXIBLE~~ CLOSURE

[76] Inventor: James F. Levy, 434 Barnwell St., Columbia, S.C. 29202

[21] Appl. No.: 787,315

[22] Filed: Oct. 30, 1991

Related U.S. Application Data

[63] Continuation-in-part of Ser. No. 588,365, Sep. 26, 1990, abandoned.

[51] Int. Cl.[5] ..... A47H 15/00; E05D 15/06

[52] U.S. Cl. ..... 16/87.4 R; 16/94 D; 16/95 D; 49/409; 248/264

[58] Field of Search ..... 16/87.2, 87.4 R, 87.6 R, 16/87 R, 87.4 W, 89, 93 D, 94 R, 94 D, 95 R, 95 D, 96 R, 96 D, 96 L, 97; 49/409, 410, 425; 160/266, 281, 330, 348; 248/262, 264

[56] References Cited

U.S. PATENT DOCUMENTS

| | | | |
|---|---|---|---|
| 786,045 | 3/1905 | Metzger | 248/262 |
| 1,227,020 | 5/1917 | Thompson | 248/262 |
| 1,661,137 | 2/1928 | Furlong | 16/89 |
| 2,293,662 | 8/1942 | Richardson | 248/264 |
| 3,175,243 | 3/1965 | Weber | 16/87.4 R |
| 3,861,001 | 1/1975 | Pape | 16/87.2 |
| 4,115,899 | 9/1978 | Ford | 16/87.4 R |
| 4,125,143 | 11/1978 | Pape et al. | 160/348 |
| 4,217,676 | 8/1980 | Terrones | 16/87.2 |
| 4,729,148 | 3/1988 | Levy | 16/87.2 |
| 4,811,520 | 3/1989 | Duggan et al. | 49/409 |
| 4,972,895 | 11/1990 | Meshaka | 160/330 |

*Primary Examiner*—Lowell A. Larson
*Assistant Examiner*—Thomas C. Schoeffler
*Attorney, Agent, or Firm*—Michael A. Mann

[57] ABSTRACT

A flexible closure support system comprising two end brackets secured to walls with a rail therebetween and supported thereon. A plurality of carriers are carried by the rail and are freely movable the length of the rail. The carriers have button assemblies hooked to one end and roller assemblies hooked to the other end of a symmetric shank. The flexible closure is fastened to the carriers by buttons on the button assemblies; the roller assemblies slide and roll in a roller channel in the rail. Pivoting, pendulum locks attached to the end brackets limit upward movement of the rails when engaging the upper surface of the rail but can be rotated out of the way with the thumb to remove the rail. Optional, resilient accent strips can be pressed into a channel running the length of the rail.

7 Claims, 3 Drawing Sheets

SUPPORT SYSTEM FOR A FLEXIBLE CLOSURE

This is a continuation-in-part of copending application(s) Ser. No. 07/588,365 filed on Sep. 26, 1990, now abandoned.

BACKGROUND OF THE INVENTION

1. Field of the Invention

The present invention relates to support systems for flexible closures such as shower curtains and the like. More specifically, the present invention relates to rail, end bracket and carries for supporting a flexible closure.

2. Discussion of the Background

The most common type of support for a shower curtain consists of an overhead horizontal support bar on which shower curtain suspension hooks or rings are slidably mounted with the hooks or rings engaging through apertures formed in the shower curtain near its top edge. There is a tendency for the shower curtain to separate from the suspension hooks during usage which necessitates frequent re-attaching of the curtain to the hooks, which is inconvenient.

There are numerous other systems for supporting flexible closures. See for example, U.S. Pat. No. 4,217,676 issued to Terrones, U.S. Pat. No. 3,861,001 issued to Pape, U.S. Pat. No. 3,175,243 issued to Weber, and U.S. Pat. No. 1,227,020 issued to Thompson. More recently, see my flexible closure carrier in U.S. Pat. No. 4,729,148 issued in March 1988.

The characteristics of a good flexible closure support system are that it be easily manufactured, easily assembled, easily installed, and certain in its hold on the supported closure. Additionally, the support system should allow the easy removal of the flexible closure for cleaning and should also have a decorative appearance.

SUMMARY OF THE INVENTION

According to its major aspects, the present invention is a flexible closure support system comprising a pair of end brackets and a rail positioned between the end brackets, with each end of the rail supported on one of the brackets. A plurality of carriers is carried by a carrier channel in the rail so that the carriers may freely slide the length of the rail. There are means for fastening the flexible closure to the carriers, preferably buttons on the carriers that fit into button holes in the top edge of the flexible closure, and means for locking the rail onto the end brackets, preferably pendulum locks snapped onto pivot posts on each end bracket. The locks are positioned off-center so gravity pulls them into engagement with the top of the rail whereby upward movement of the rail is resisted until the lock is pivoted out of the way. The carriers each comprise a shank that has hooks symmetrically formed in its ends so that a roller assembly or a button assembly can be snapped easily into position, but not easily out of position, on either end. Accent channels may optionally be provided in the rail to receive resilient strips of material.

It is a feature of the present invention that the carrier has an identical hook on each end that will receive either the roller assembly or the button assembly. This feature simplifies the assembly of the carriers. Furthermore, the shape of the hooks makes it relatively easy to snap the roller or button assembly into place but relatively difficult to remove them.

It is another feature of the present invention that the flexible closure can button to the carrier. The advantage of this feature is that the support system does not have to be taken down to remove the closure, such as for cleaning. If the flexible closure comprises a water control panel and a decorative panel, as in some shower curtains, the decorative panel buttons to the carrier and the control panel fits onto the other end of the button assembly. For cleaning, the decorative panel is unbuttoned and washed separately; the water control panel and the carriers, preferably made of durable plastic, can be easily removed from the rail and washed together, without separating the control panel and the carrier. Furthermore, the buttons themselves can carry decorative featurs, as opposed to clips or hooks for fastening the closure to the carriers. A related feature of the present invention that also involves decoration is the accent channel running preferably the length of the rail for receiving the strip of resilient material. The color of the strip can be selected to match the color of the buttons.

Still another feature of the present invention is the locking mechanism. The locking mechanism is a pendulum lock pivotally mounted to the end bracket. The pendulum is mounted off center so that it rotates by gravity to engage the top surface of the rail as the rail rests on the bottom flange of the bracket and astride the bracket stop. The locking mechanism prevents the rail from being accidentally lifted off the bracket but does not prevent easy one-handed removal by simply pushing the pendulum out of the way.

Still another feature of the present invention is the shank of the carrier in both embodiments. One embodiment features the hooks described breifly above, a simpler construction that is especially suited for lighter weight closures. An alternative embodiment is better suited for heavier closures. The alternative embodiment has means for limiting deformation of the carrier when closures are fastened to them. In particular, the shank bifurcates at one end to form two points of support for the fastening means, preferably a button with an axle, rather than one. Also, the hooks of the simpler embodiment are replaced with key locks for additional resistance to deformation. This arrangement helps to hold the button so that its face is more vertical in spite of the weight of the closure.

These and other features and advantages of the present invention will be apparent to those skilled in the art of flexible closure support systems from a careful reading of the Detailed Description of a Preferred Embodiment accompanied by the drawings briefly described below.

DETAILED DESCRIPTION OF THE PREFERRED EMBODIMENTS

Figure 1:
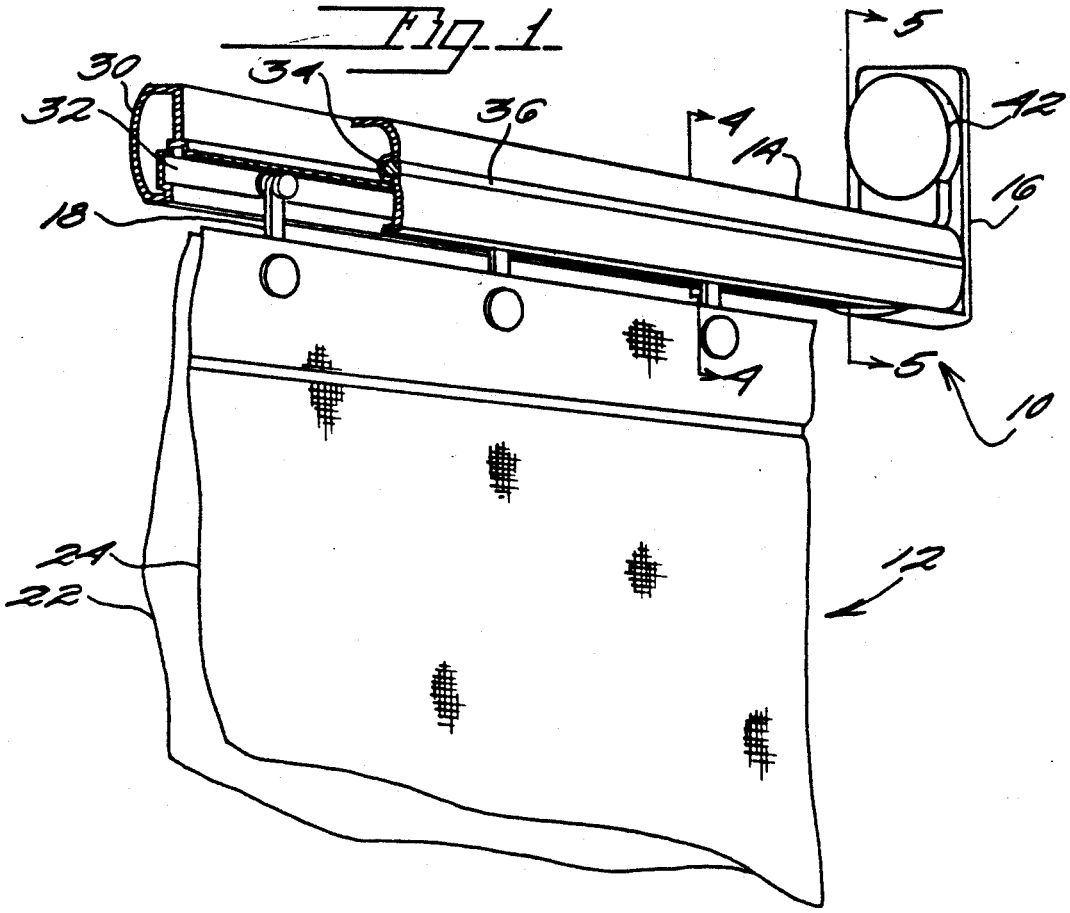
FIG. 1 is a perspective view of a preferred embodiment of the flexible closure system according to the present invention.

Referring now to FIG. 1, there is illustrated a preferred embodiment of the present invention, a support system 10 for a flexible closure 12 such as shower curtain, a temporary wall, a screen, and the like. The support system 10 has three major components: a rail 14, two end brackets 16 (only one shown in FIG. 1, the other end bracket being identical and located at the opposing end of rail 14), and a plurality of carriers 18.

Flexible closure 12 will be attached to carriers 18 so that it hangs therefrom. In the case of a shower curtain, the flexible closure can be a two part affair, as shown in FIG. 1, having a water control panel 22 to the interior of the shower and a decorative panel 24 to the exterior, both parts of which depend from the carriers.

Briefly, rail 14 comprises a shell 30 with a roller channel 32 and an accent channel 34 defined therein. An accent strip 36 made of any resilient material can be pushed into accent channel 34 for decorative purposes. Carriers 18 are free to roll or slide freely throughout the length of roller channel 32.

Figure 5:
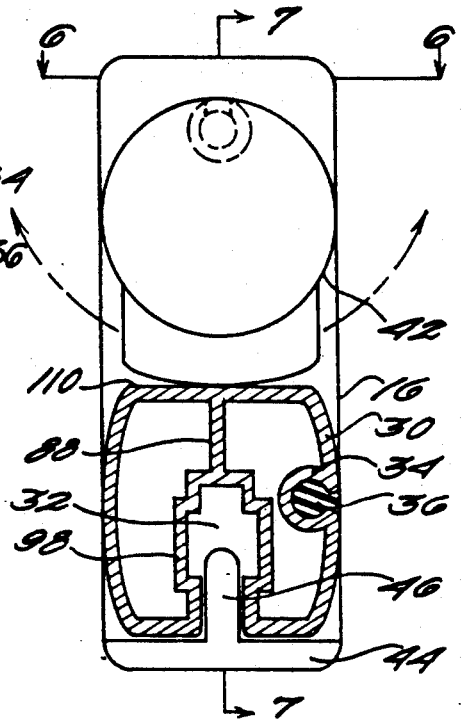
FIG. 5 is a side view of a preferred embodiment of the bracket and a cross sectional view of the rail according to the present invention.

End bracket 16, best seen in FIG. 5, comprises a pendulum lock 42, a flange 44 underneath and supporting rail 14, and a stop 46 to provide lateral support for rail 14. Pendulum lock 42 will be described more fully below.

Figure 2:
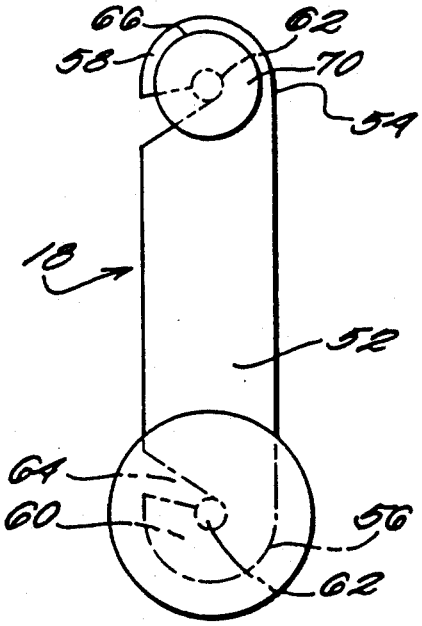
FIG. 2 is a front view of a preferred embodiment of the carrier of the present invention.
Figure 3:
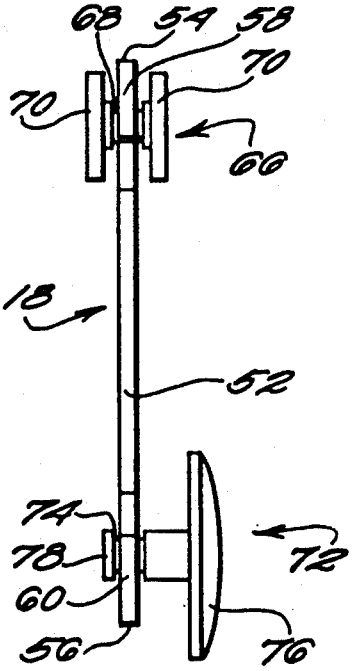
FIG. 3 is an end view of the carrier shown in FIG. 2.

Each carrier 18, as better seen in FIGS. 2 and 3, comprises a shank 52 having a first end 54 and a second end 56. First end has a first hook 58; second end has a second hook 60. Shank 52 is symmetrical and first end 54 and first hook 58 are mirror images of second end 56 and second hook 60. Each hook 58, 60 has a circular cut out portion 62 and a connecting, angled cut out portion 64.

A roller assembly 66 is carried by rail 14. Roller assembly 66 has an axle 68 and two wheels 70. Axle 68 of roller assembly 66 turns freely in circular cut out portion 62 and is positioned in circular cut out portion 62 by moving it along angled cut out portion 64 toward circular cut out portion 62. As roller assembly 66 moves into position, axle 68 will engage the sides of angled cut out portion 64 causing hook 58, or 60, to spread until axle is seated in circular cut out portion 62, at which point, hook 58 or 60 snaps back. Removal of roller assembly is relatively more difficult because there is no ramp-like angled cut portion 64 to facilitate the spreading of hook 58 or 60 by axle 68. Thus roller assembly will not easily be removed from circular cut out portion 62.

A button assembly 72 is attached to second end 56 of shank 52 in a fashion similar to roller assembly 66. Button assembly 72 also has an axle 74 but has a button 76 attached to one end of axle 74 and a disk 78 at the other. Button 76 has a spacer 80 behind it to accommodate one or more layers of flexible closure 12.

Figure 4:
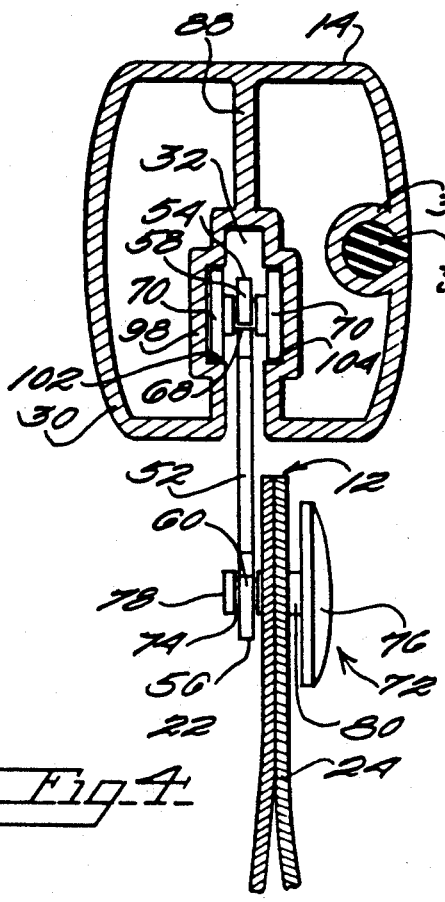
FIG. 4 is a cross sectional view of a preferred embodiment of the rail and carrier of the present invention.

FIG. 4 illustrates the relationship between carrier 18 and rail 14. Shell 30 is generally a rounded rectangle bifurcated by roller channel 32 and support 88. To one side of rail 14 is accent channel 34 with accent strip therein. There may be additional accent channels formed in shell 30 in different orientations, such as circumferentially or in a spiral or helix pattern. Roller channel 32 has an expanded portion 98 to define two sills 102 and 104 on which wheels 70 are carried. Roller channel 32 is not otherwise wide enough for roller assembly to enter roller channel 32 but is just slightly wider than the width of shank 52 plus a little room to allow carrier to bend slightly under the weight of flexible closure 12.

Support 88 provides support especially for heavier flexible closures and helps to prevent distortion of rail 14. Rail 14 can be extruded of metal, plastic or any other reasonably rigid material.

FIG. 5 illustrates the relationship between end bracket 16 and rail 14. Rail 14, in cross section is shown supported on flange 44 of end bracket and astride stop 46. Flange 44 prevents downward movement of rail 14 and stop 46 prevents lateral movement of rail 14. Rail 14 has a top surface 110 that is engaged by pendulum lock 42. Pendulum lock 42 is pivotally supported by a post 112 (FIG. 6) attached to end bracket 16. A hole off center of pendulum lock 42 receives post 112 and allows pendulum lock 42 to rotate freely about post 112. Since the hole is off center, pendulum lock 42 will be pulled by gravity to have its center of gravity below post 112. Its center of gravity corresponds to its longest radius from the hole. Thus pendulum lock 42 will tend to return to the position in which it is shown in FIG. 5. However, by simply pushing lock 42, it will rotate about post 112 and disengage itself from top surface 110. Without deliberate effort to push pendulum lock 42, however, it will remain as shown, engaging top surface 110 and thereby holding rail 14 in position, restrained from vertical movement, such as in the event rail 14 is accidentally bumped upwardly.

Figure 6:
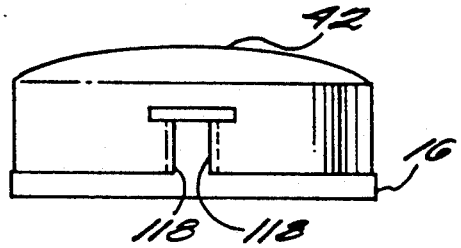
FIG. 6 is a top view of a preferred embodiment of the pendulum lock according to the present invention.
Figure 7:
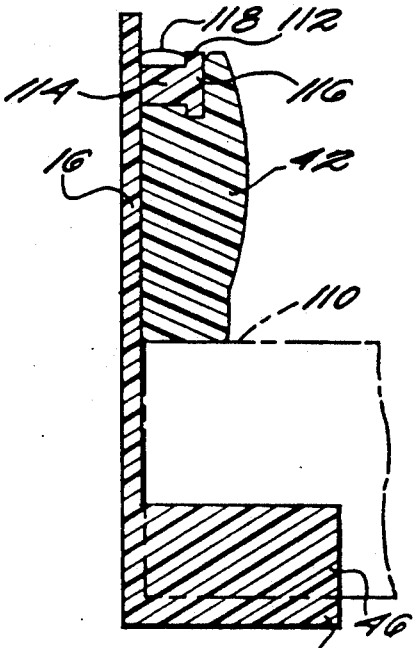
FIG. 7 is a side cross sectional view of the end bracket and pendulum lock according to the present invention.

FIGS. 6 and 7 show a top view of end bracket 16 and a side cross sectional view of end bracket 16. Post 112 has a stem 114 and a flange 116, stem 114 serving as an axle for rotation of pendulum lock 42 and flange 116 which helps to assure that pendulum lock 42 stays on post 112. The top of pendulum lock has two fingers 118 that come together slightly closer than the width of stem 114 allowing pendulum lock to be snapped into place during assembly.

The present support system 10 is assembled by obtaining the desired number of shanks 52, roller assemblies 66 and button assemblies; snapping one roller assembly into first hook 58 and one button assembly into second hook 60 (which hooks are symmetrical); pressing a resilient accent strip 36 of the same color as buttons 76 of button assemblies 72 into accent channel 34; and snapping one pendulum lock 42 onto post 112 of each of two end brackets 16.

Figure 8:
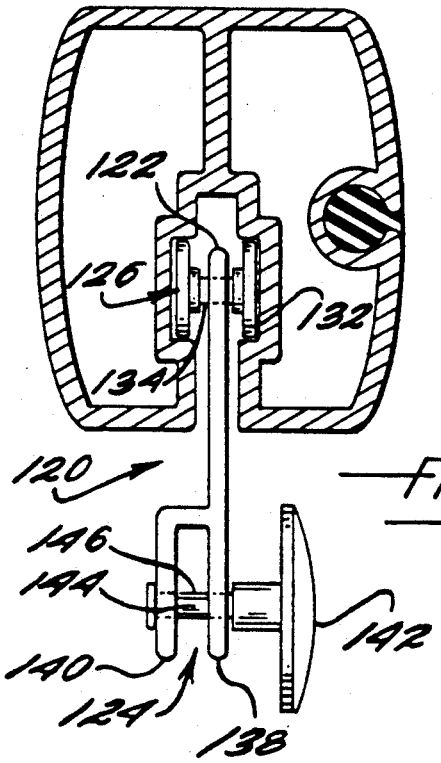
FIG. 8 shows a cross section of an alternative embodiment of the shank in a rail according to the present invention.
Figure 9:
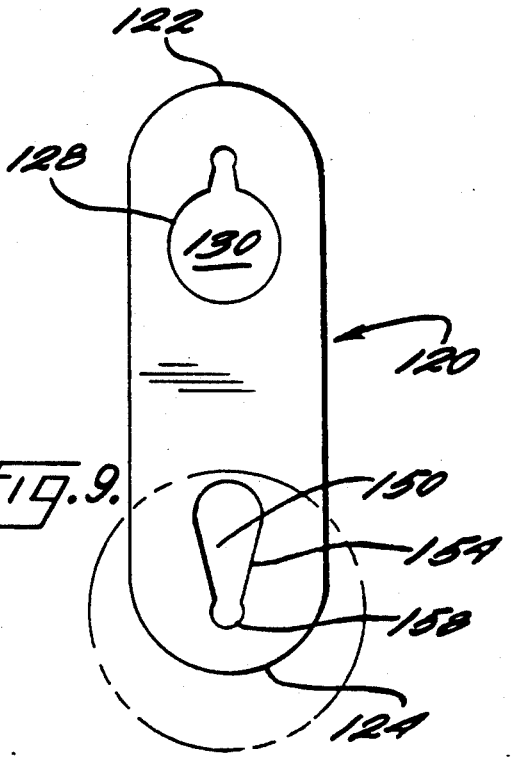
FIG. 9 shows a front view of the alternative embodiment of the shank of FIG. 8.
Figure 10:
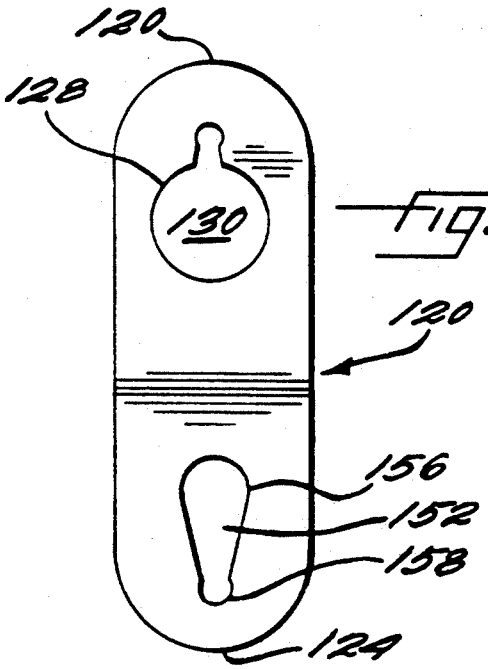
FIG. 10 shows a back view of the alternative embodiment of the shank of FIG. 8.

FIGS. 8, 9 and 10 illustrate an alternative embodiment of the shank, suitable for heavier closures. Shank 120 has a first end 122 and a second end 124. First end 122 has means formed therein for receiving and preferably securing a roller assembly 126. The receiving means shown is a key lock 128; that is, key lock is a shaped hole 130 that allows a wheel 132 of roller assembly 126 to be pushed through hole 130 and then locked by snapping the axle 134 of roller assembly 126 into the smaller diameter portion 136 of hole 130.

At second end 124, shank 120 is bifurcated to form a first support 138 and a second support 140. Second support 140 is spaced apart from first support 138 for leverage and in acting in compression to hold the fastening means in a more nearly horizontal orientation. Fastening means is also a button 142 having an axle 144 that has reduced diameter portion 146. Both first support 138 and second support 140 have shaped holes 150, 152 that receive axle 144 in a larger portion 154, 156 of holes 150, 152, respectively, but receive reduced portion 146 in smaller portions 158, 160, respectively, to lock axle 144 in place. Preferably, reduced portions 146, 148, of axle 144 should be dimensioned to just fit into smaller portions 158, 160, requiring a snapping action to full seat and thus lock axle 144 in place.

The weight of the closure will pull down on axle 144 just behind button 142. Downward motion of axle will be resisted by its engagement with first support 138 and also second support 140, thus preventing or at least limiting a rotation of axle 144 about first support 138 or a bending of shank 120.

In use, two end brackets 16 are attached to opposing walls at the same elevation by screws, nails or other convenient fastening means, one bracket 16 on each wall. Then carriers 18 in the requisite number are loaded into roller channel 32 of rail 14 with buttons 76 on the same side of carrier 18 as accent strip 36 is on rail 14. With pendulum lock 42 rotated aside, rail 14 is then brought down onto flange 44 astride stop 46 of a first end bracket 16, and then the other. Pendulum locks 42 are released after rail 14 is seated on flange 44. Finally, flexible closure 12 is button-fastened to carriers 18.

For cleaning, decorative panel 24 (FIG. 1) is unbuttoned from carrier 18 and washed separately. To wash water control panel 22, pendulum locks 42 are rotated aside and rail 14 lifted clear of bracket 16. Then carriers 18 together with roller assemblies 66 and button assemblies 72 (FIG. 3) are allowed to roll to one end of rail 14 with water control panel 22 for removal. Water control panel 22 and carriers 18 remain attached to each other for washing.

It will be apparent to those skilled in the art of flexible closure assemblies that many additions and modification can be made in the specific descriptions of the preferred embodiments without departing from the spirit and scope of the present invention which is to be defined in accordance with the appended claims.

What is claimed is:

1. A system for supporting a flexible closure, said system comprising:

a pair of brackets;

a rail having a channel formed therein, said rail supported by said brackets, said brackets preventing rotational movement of said rail;

a plurality of carriers carried by said rail;

means for fastening said flexible closure to said plurality of carriers, said carrier having a roller assembly and a shank, said shank having a first end and a second end, said first end having a first shaped hole for receiving said roller assembly, said roller assembly supported within and rolling freely in said channel and in said first end of said shank, said first shaped hole having a first portion with a larger diameter and a second portion with a smaller diameter, said second portion communicating with said first portion so that said roller assembly can be inserted through said first portion of said first shaped hole of said shank but not through said second portion of said first shaped hole of said shank so that said roller assembly can be inserted through said first portion and moved to said second portion to secure said roller assembly in said first end of said shank.

2. The system as recited in claim 1, wherein said second end of said shank is bifurcated to form a first support with a first hole and a second support with a second hole, said second support spaced apart from said first support, said fastening means carried by said first support and said second support in said first and second holes.

3. The system as recited in claim 1, wherein said fastening means further comprises a plurality of button assemblies, each button assembly carried by said one carrier of said plurality of carriers.

4. The system as recited in claim 1, wherein said channel has a pair of sills formed therein and said roller is supported by and rolls freely on said sills.

5. The system as recited in claim 1, wherein said brackets support said rail therebetween and prevent axial movement of said rail.

6. The system as recited in claim 1, wherein said brackets further comprise means for locking said rail to said brackets to prevent vertical movement of said rail, said locking means having a locked position and an unlocked position and being rotatable about an axis parallel to the long axis of said rail between said locked position and said unlocked position, said rail being prevented from moving in the vertical direction unless said locking means is rotated from said locking position to said unlocking position.

7. A system for supporting a flexible closure, said system comprising:

a pair of brackets;

a rail having two opposing ends and a channel formed therein, said rail positioned between said pair of end brackets so that said end brackets limit axial movement of said rail, each end of said rail supported by one of said brackets;

a plurality of carriers carried by said rail; and means for fastening said flexible closure to said plurality of carriers, each of said carriers having a roller and a shank, said shank with a first end and a second end, said first end having a first shaped hole for receiving said roller, said roller being receivable in said channel and rolling freely therein, said second end having a second shaped hole for receiving said fastening means, said first shaped hole having a first portion with a larger diameter and a second portion with a smaller diameter, said second portion communicating with said first portion so that said roller assembly can be inserted through said first portion of said first shaped hole of said shank but not through said second portion of said first shaped hole of said shank so that said roller assembly can be inserted through said first portion of said first shaped hole and moved to said second portion of said first shaped hole to secure said roller assembly in said first end of said shank, said second shaped hole having a first portion and a second portion, said first portion of said second shaped hole having a larger diameter and said second portion having a smaller diameter, said first portion communicating with said second portion, said fastening means further comprising a button assembly having a button with an axle attached thereto, said axle having a first portion and a second portion having a reduced diameter, said first portion dimensioned for extending through said first portion of said second shaped hole but not for extending through said second portion of said second shaped hole so that the axle of said button assembly can be extended through said first portion of said second shaped hole of said shank and moved to said second portion of said second shaped hole to secure said button assembly in said second end of said shank.

* * * * *